United States Patent [19]

LaFleur

[11] Patent Number: 4,596,174

[45] Date of Patent: Jun. 24, 1986

[54] WIRE HANDLING AND CUTTING APPARATUS

[75] Inventor: James K. LaFleur, Toluca Lake, Calif.

[73] Assignee: GTI Corporation, San Diego, Calif.

[21] Appl. No.: 687,476

[22] Filed: Dec. 28, 1984

[51] Int. Cl.[4] ..... B65H 51/18

[52] U.S. Cl. ..... 83/153; 83/245; 83/277; 83/424; 83/593; 226/112; 226/166

[58] Field of Search ..... 83/277, 245, 251, 424, 83/153, 593; 140/140, 139; 226/112, 114–116, 162–167

[56] References Cited

U.S. PATENT DOCUMENTS

| | | | |
|---|---|---|---|
| 1,897,970 | 2/1933 | Hofmann et al. | 83/277 |
| 1,986,356 | 1/1935 | Palucki | 140/140 |
| 2,126,453 | 8/1938 | Criley et al. | 226/112 X |
| 2,228,748 | 1/1941 | Berkebil | 226/166 X |
| 2,657,933 | 11/1953 | Stuebner | 226/166 X |
| 2,817,534 | 12/1957 | Cox | 226/166 X |
| 3,549,072 | 12/1970 | Ito | 226/167 X |
| 3,677,120 | 7/1972 | Sieurin | 83/591 X |
| 3,690,533 | 9/1972 | Bihler | 226/165 |
| 3,844,152 | 10/1974 | Peytavin | 226/112 X |

*Primary Examiner*—James M. Meister

*Attorney, Agent, or Firm*—Morland C. Fischer

[57] ABSTRACT

A high speed wire handling and cutting apparatus having particular application for efficiently providing a continuous supply of uniform dimension wire leads which are to be electrically connected (e.g. welded) to an electronic component, or the like, so that such component can be connected into an electrical circuit. The apparatus includes a wire feeding crank and an associated cross head assembly, a wire receiving crank and an associated cross head assembly, and a wire cutter disposed therebetween. The wire feeding crank and its associated cross head assembly continuously feed an accurately metered length of wire from a wire supply to the cutter, so that wire sections of precise and uniform dimension can be cut therefrom. The wire receiving crank and its associated cross head assembly embrace the sections of wire that are cut from the supply and transfer the sections from the cutter to a suitable storage facility or to the next stage in an electronic component packaging and/or manufacturing assembly line.

7 Claims, 7 Drawing Figures

WIRE HANDLING AND CUTTING APPARATUS

BACKGROUND OF THE INVENTION

1. Field of the Invention

This invention relates to a high speed wire handling and cutting apparatus for continuously feeding accurately metered lengths of wire from a wire supply to a cutter, so that wire sections of precise and uniform length may be cut from the supply and delivered to either a storage facility or to a succeeding stage (e.g. a high speed welder) in a packaging and/or manufacturing assembly line. By way of example, the present wire handling and cutting apparatus has particular application to the packaging of electronic components, or the like, wherein wire leads of particular dimension are provided for electrical connection to the components.

2. The Prior Art

For many high speed applications, and particularly in the packaging of electronic components, or the like, wire sections having a precise and uniform length are required. However, conventional wire handlers and wire cutters are commonly characterized by the inability to continuously and accurately meter out a particular length of wire from a supply thereof, so that such precise and uniform length wire sections can be delivered to and cut, at high operating speeds, by the wire cutter.

What is more, conventional wire handlers and wire cutters are often characterized by a lack of efficiency. That is, some wire handlers and cutters temporarily release or lose contact with the wire sections once they are cut from a wire supply. In order to transfer the wire sections to a succeeding stage (such as, for example, a high speed welder) in a packaging and/or manufacturing assembly line, the wire handler must again locate and engage each section. This temporary disengagement of the wire handler from the wire sections may undesirably delay the packaging and/or manufacturing process, because of the additional time needed to re-engage and properly align each wire section for delivery to the succeeding assembly line stage. Such delay may become acute at high operating speeds when a steady stream of wire sections must be continuously cut and delivered to the succeeding stage.

SUMMARY OF THE INVENTION

It is therefore a primary object of the present invention to overcome the disadvantages which characterize the prior art and to provide a wire handling and cutting apparatus suitable for high speed operation, whereby accurately metered and uniform length wire sections can be fed to and cut by a wire cutting assembly.

It is a further object of the present invention that the presently disclosed wire handling and cutting apparatus include wire handling means which remains in contact with and thereby continuously engages the wire sections which have been fed to and cut by the cutting assembly, so that a steady stream of individually cut wire sections can be efficiently delivered from the cutting assembly to a succeeding stage in a packaging and/or manufacturing assembly line.

It is another object of the present invention that the presently disclosed wire handling and cutting apparatus be particularly applicable to the packaging of electronic components, or the like, where precisely measured and uniform length wire sections can be accurately cut from a wire supply and delivered to a succeeding stage (e.g. a high speed welder) of a packaging assembly line, so that the wire sections can be electrically connected to respective electronic components to form the leads thereof.

The foregoing is accomplished by the presently disclosed wire handling and cutting apparatus. A continuous supply of wire is advanced from a reel to a wire cutting assembly where wire sections are cut therefrom. The wire is advanced to the cutting assembly by a wire feeding crank and an associated cross head assembly. The cross head assembly comprises a cylinder having a piston which is adapted for reciprocating movement therethrough. The movement of the piston through the cylinder is controlled by the wire feeding crank which comprises a rotating drive wheel that is interconnected with the piston by way of a connecting rod. The connecting rod extends between a slot formed in the drive wheel and the piston, so that rotational movement of the drive wheel can be transferred to cause linear (i.e. reciprocating) movement of the piston.

A collet is disposed at the interior of the piston for receiving the wire therethrough. The collet has cooperating jaws which are oriented to securely grip the wire for advancing the wire towards the cutting assembly when the piston moves through the cylinder in a direction towards the cutting assembly. The collet jaws release the wire when the piston moves through the cylinder in an opposite direction away from the cutting assembly. Thus, the jaws of the collet act to effect an unimpeded feed of wire in a single direction from the wire reel to the cutting assembly so that sections of wire can be repeatedly cut at relatively high speed.

A second cross head assembly and an associated wire receiving crank are located at the exit side of the wire cutting assembly for receiving the wire sections which have been cut thereby. The second cross head assembly and wire receiving crank operate to deliver such wire sections to either a storage facility or to a succeeding stage (e.g. a high speed welder) of a packaging and/or manufacturing assembly line.

DESCRIPTION OF THE PREFERRED EMBODIMENT

Figure 1:
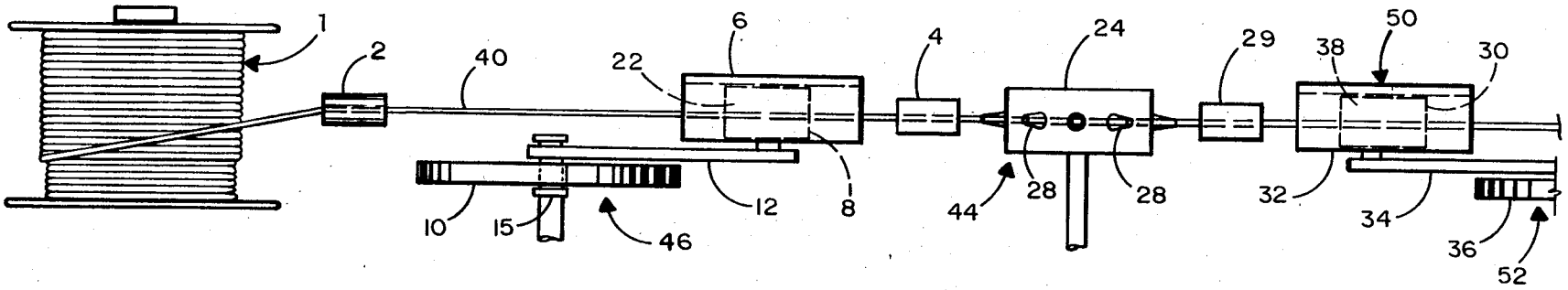
FIG. 1 is a top view of the wire handling and cutting apparatus which forms the present invention.
Figure 2:
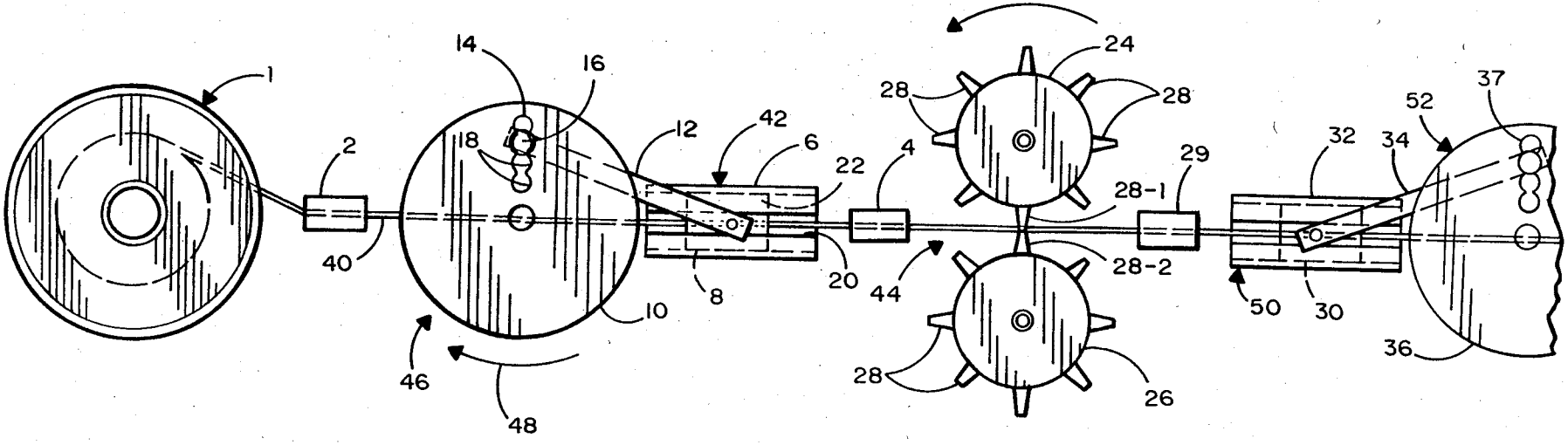
FIG. 2 is a front view of the wire handling and cutting apparatus of FIG. 1.

Referring concurrently to FIGS. 1 and 2 of the drawings, the wire handling and cutting apparatus which forms the present invention is described in detail. Typically, a continuous supply of wire 40 is wound upon a conventional reel 1. The wire 40 is threaded through an incoming wire guide 2. The wire is fed from incoming wire guide to an outgoing wire guide 4 by way of a first cross head assembly 42. Wire guides 2 and 4 are preferably thin walled cylindrical tubes which facilitate a desirable (i.e. coaxial) alignment of the wire 40 relative to cross head assembly 42.

Cross head assembly 42 comprises a sleeve or cylinder 6 and a piston 8. As will soon be explained, the piston 8 is adapted for reciprocating movement through cylinder 6 so as to advance the wire 40 in a single direction from the wire reel 1 to a wire cutting assembly 44. The reciprocating movement of piston 8 through cylinder 6 is controlled by a wire feeding crank 46 which is interconnected with the piston 8 by means of a connecting rod or cross link 12.

More particularly, wire feeding crank 46 comprises a rotating drive wheel 10 having a radially extending adjustment slot 14 formed therein. Drive wheel 10 is mounted for rotation (in a direction indicated by arrow 48) around a crank shaft 15. A first end of connecting rod 12 is releasably and pivotably connected at the adjustment slot 14 of drive wheel 10 by a connecting bearing 16. The length of the sections cut from wire supply 40 by cutting assembly 44 may be accurately established and/or selectively changed by varying the cross head throw (i.e. the distance between crank shaft 15 and connecting bearing 16). To this end, the radially extending adjustment slot 16 may include a series of ports 18 (best shown in FIG. 2) in which to receive the connecting bearing 16 for fixing the position at which the first end of connecting rod 12 is secured to the drive wheel 10. The cross head throw and the corresponding length of wire to be cut from wire supply 40 is determined by the particular port of the series of ports 18 which is in receipt of connecting bearing 16.

The second end of connecting rod 12 is secured to piston 8 through an axially extending slit 20 (also best shown in FIG. 2) formed along a side of cylinder 6. So that the rotational movement of drive wheel 10 can be transferred via connecting rod 12 to cause the linear, reciprocating movement of piston 8 through cylinder 6, the second end of connecting rod 12 is pivotally connected to piston 8 through slit 20.

Figure 3:
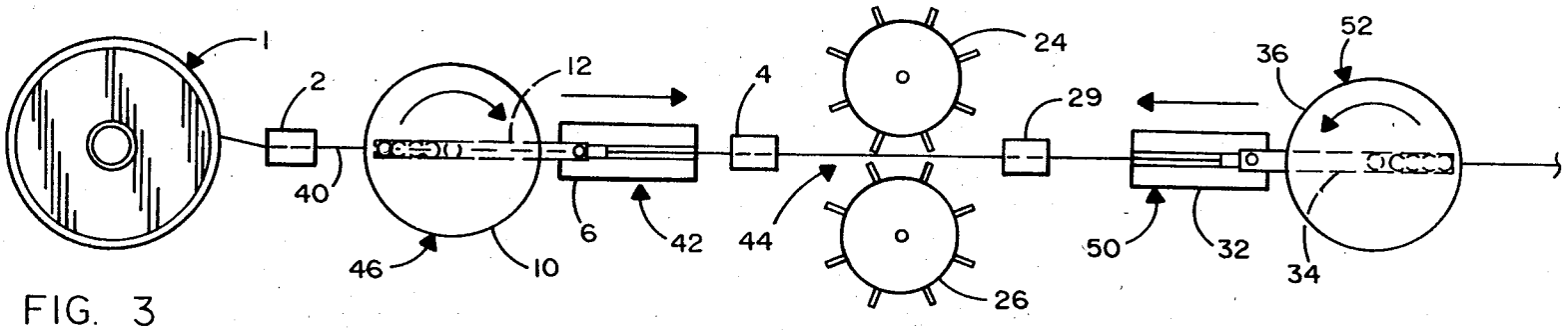
FIGS. 3–5 illustrate various stages of operation of the present wire handling and cutting apparatus for advancing a continuous supply of wire in a single direction past the cutting wheels of a cutting assembly for cutting off sections of wire and for efficiently delivering the wire sections to either a storage facility or to a succeeding stage in a packaging and/or manufacturing assembly line.
Figure 4:
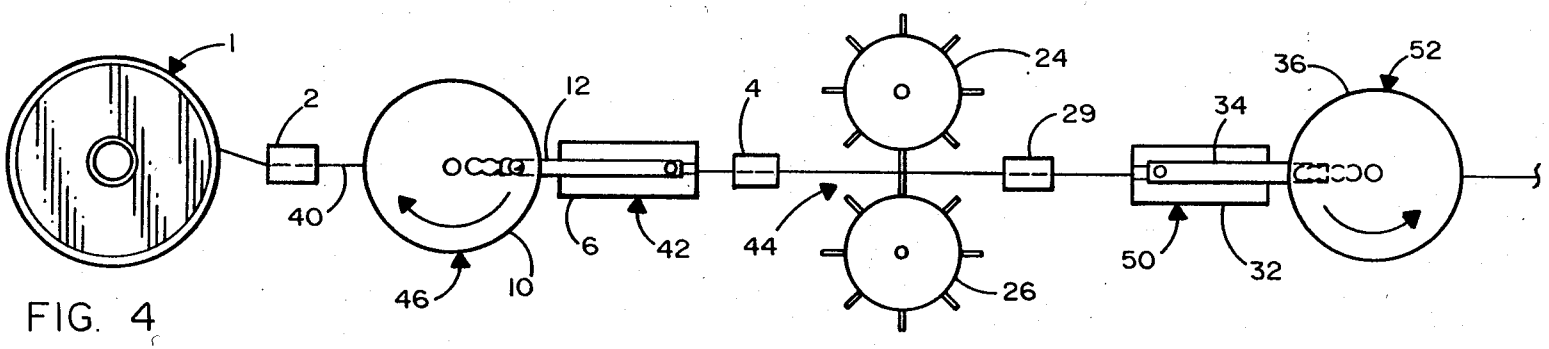
Figure 5:
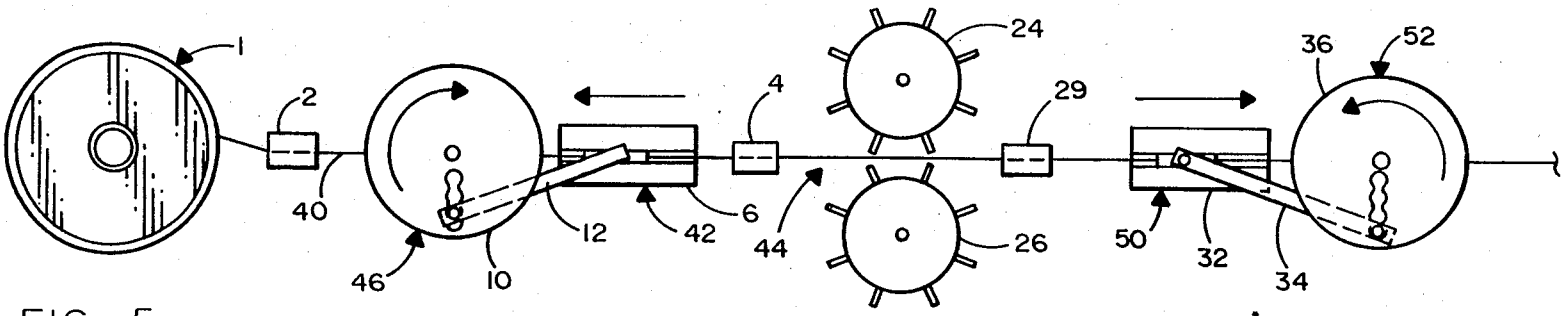

In accordance with the present invention, a collet 22 (best described when referring to FIGS. 6 and 7, hereinafter) is disposed at the interior of piston 8 and oriented so that the wire supply 40 extends in coaxial alignment therethrough. In general terms, collet 22 comprises clamping jaws which cooperate with one another to securely grip the wire 40 for advancing the wire in a forward direction towards the wire cutting assembly 44 at such time corresponding to the forward movement of piston 8 through cylinder 6 (best depicted in FIG. 3 of the drawings). The collet jaws must also be adapted to disengage from one another and thereby release the wire 40 at such time corresponding to the movement of the piston 8 through cylinder 6 in an opposite or rearward direction away from cutting assembly 44 (best depicted in FIG. 5 of the drawings). The dimensions of drive wheel 10 and connecting rod 12 can be chosen to permit the jaws of collet 22 to dwell at the forwardmost end of the piston stroke through cylinder 6 (best depicted in FIG. 4 of the drawings) for a time sufficient to permit the cutting assembly 44 to cut the wire 40. Thus, the cutting assembly 44 will not be required to cut wire 40 on the fly. Moreover, and as is also shown in FIG. 4, at the moment during which the wire 40 is cut, the connecting rod 12 is fully extended in the forward direction from adjustment slot 14 of drive wheel 10 towards the cutting assembly 44, such that the longitudinal axes of piston 8 and rod 12 are aligned parallel to one another.

Located between cross head assembly 42 and the wire cutting assembly 44 is the outgoing wire guide 4. The wire is advanced through wire guide 4 by way of collet 22 whenever piston 8 is moved in a forward direction through cylinder 6, as previously described.

By way of particular example, the wire cutting assembly 44 may comprise upper and lower cutting wheels 24 and 26. Each of the cutting wheels 24 and 26 includes a respective plurality of tangs or cutting edges projecting radially outward therefrom and uniformly spaced therearound. The cutting wheels 24 and 26 are horizontally aligned and spaced from one another so as to permit the forward advancing wire 40 to be received at the interface of two opposing tangs (e.g. 28-1 and 28-2) at which location the wire is severed. It may be desirable to position the cutting wheels 24 and 26 so that the interface between such opposing tangs 28-1 and 28-2 is slightly higher than outgoing wire guide 4. Thus, the longitudinal axis of wire guide 4 may be slanted or aligned to form an upward extending angle (not shown) to cutting assembly 44 with respect to the horizontal. In this way, the wire 40 will be better able to clear the lower cutting wheel 26 after the cut has been made.

While each of the cutting wheels 24 and 26 may be adapted for synchronous rotation around respective shafts for repeatedly cutting the wire as it passes between the interface of pairs of opposing tangs (e.g. 28-1 and 28-2), it is to be understood that only one wheel (e.g. top cutting wheel 24) need rotate. Thus, the other wheel (e.g. bottom cutting wheel 26) would remain stationary. Therefore, only a single cutting tang (e.g. 28-2) would project upwardly from stationary cutting wheel 26. In this case, both the speed of rotation and dimension (i.e. radius) of rotating cutting wheel 24 would determine the frequency at which the wire 40 is cut by cutting assembly 44. However, the length of the wire sections which are cut by cutting assembly 44 is determined by both the throw of cross head assembly 42 and the speed of rotation of drive wheel 10.

Of course, it is also within the scope of this invention for neither cutting wheel 24 nor 26 to rotate. In this case, the wire cutting assembly 44 would include opposing cutting tangs (at least one of which being adapted for reciprocal movement) for periodically engaging and cutting through the wire 40 which passes thereunder.

An exit wire guide 29, which is identical in construction and function to wire guides 2 and 4, is located at the exit side of wire cutting assembly 44 to receive sections of wire which are advanced past cutting wheels 24 and 26 by collet 22 during the forward motion of piston 8. Wire guides 4 and 29 are aligned with one another to suitably position wire 40 between the opposing tangs of cutting wheels 24 and 26 so that any desired end (e.g. pinch) cut can be completely and accurately achieved.

While the first cross head assembly 42 advances wire 40 in a direction towards wire cutting assembly 44, the wire handling and cutting apparatus of the present invention may include a second cross head assembly 50 for receiving the sections of wire which have been moved past the cutting assembly 44 and cut off the wire supply 40. Similar in construction to the first cross head assembly 42, the second cross head assembly 50 comprises a piston 30 which is adapted for reciprocating movement through a cylinder 32. The reciprocating movement of piston 30 through cylinder 32 is controlled by a wire receiving crank 52 which is interconnected with the piston 30 by means of a connecting rod 34. Wire receiving crank 52 comprises a rotating drive wheel 36 having a radially extending adjustment slot 37 formed therein. As previously disclosed when describing the adjustment slot 14 of drive wheel 10, a first end of connecting rod 34 is releasably and pivotably connected at the adjustment slot 37 of drive wheel 36 by means of a connecting bearing, or the like, so that the throw of cross head assembly 50 can be selectively adjusted, depending upon the location along adjustment slot 37 at which connecting rod 34 is affixed. The second end of connecting rod 34 is pivotally connected to piston 30 through an axially extending slit formed along the side of cylinder 32, so that the rotational movement of drive wheel 36 can be transmitted via connecting rod 34 to cause the linear, reciprocating movement of piston 30 through cylinder 32.

A collet 38 (of similar construction to collet 22 of piston 8) is disposed at the interior of piston 30 and oriented so that each of the wire sections extends in coaxial alignment through exit wire guide 29 and collet 38. Collet 38 comprises jaws which cooperate with one another to securely grip a section of wire which has been advanced by cross head assembly 42 past cutting assembly 44 to be cut from wire supply 40 by the cutting wheels 24 and 26. More particularly, the jaws of collet 38 are oppositely oriented with respect to the jaws of collet 22, so as to retain a secure grip on a section of wire which has been advanced thereto at such time corresponding to the release of wire 40 by and the movement of piston 8 through cylinder 6 in the rearward direction away from cutting assembly 44 (best depicted in FIG. 5 of the drawings). In this case, the pistons 8 and 30 of cross head assemblies 42 and 50 are moving away from one another. The jaws of collet 38 disengage from one another to release the section of wire at such time corresponding to the engagement of wire 40 by and the movement of piston 8 through cylinder 6 in the forward direction towards cutting assembly 44, best depicted in FIG. 3 of the drawings. In this case, pistons 8 and 30 are moving towards one another. The jaws of collet 38 dwell at the forward-most end of the piston stroke through cylinder 32 (best depicted in FIG. 4 of the drawings) at a time during which the wire 40 is cut by cutting assembly 44.

Accordingly, the wire 40 is advanced from wire reel 1 during the movement of piston 8 towards cutting assembly 44 (with piston 30 also moving towards cutting assembly 44), while individual sections which are cut off wire 40 are pulled away during the movement of piston 30 away from cutting assembly 44 (with piston 8 also moving away from cutting assembly 44). As a result of the opposing orientations and operations of collets 22 and 38, the wire is repeatedly advanced towards and pulled away from wire cutting assembly 44 in a single direction during the respective movements of piston 8 towards and piston 30 away from cutting assembly 44. Therefore, the jaws of collets 22 and 38 cooperate to effect the unimpeded forward feed of wire from reel 1 past the cutting wheels of cutting assembly 44 while preventing an undesirable reverse feed of wire in a direction towards the wire reel 1.

The jaws of collet 38 remain in engagement with a wire section which has been cut off wire 40 by cutting assembly 44 until piston 30 has completed its rearward stroke through cylinder 32. At this time, the collet jaws release the wire section for delivery to either a storage facility (not shown) or a succeeding stage (also not shown) in a packaging and/or manufacturing assembly line. Inasmuch as wire 40 and the sections which are cut therefrom are continuously engaged by collets 22 and/or 38, the wire sections may be efficiently and continuously transferred to such a succeeding assembly line stage. By way of example, the presently disclosed wire handling and cutting apparatus may form one stage of a high speed electronic component packaging and/or manufacturing system. That is, the wire sections provided by wire cutting assembly 44 may be transferred without interruption and in suitable alignment to a succeeding high speed welding stage by which wire sections of predetermined and accurately metered length can be electrically connected to an electronic device so as to form the leads thereof.

Figure 6:
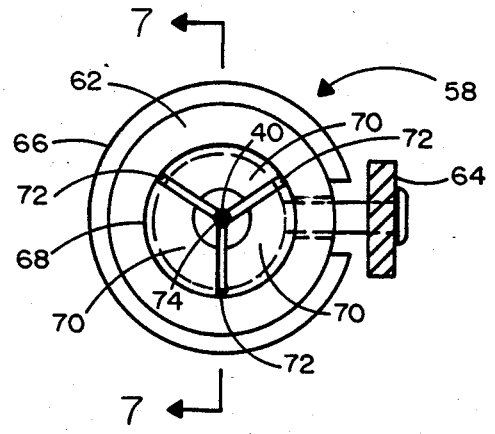
FIG. 6 is an end view of a collet which is disposed at the interior of a reciprocating piston of a cross head assembly of the present wire handling and cutting apparatus for advancing the wire in the single direction.
Figure 7:
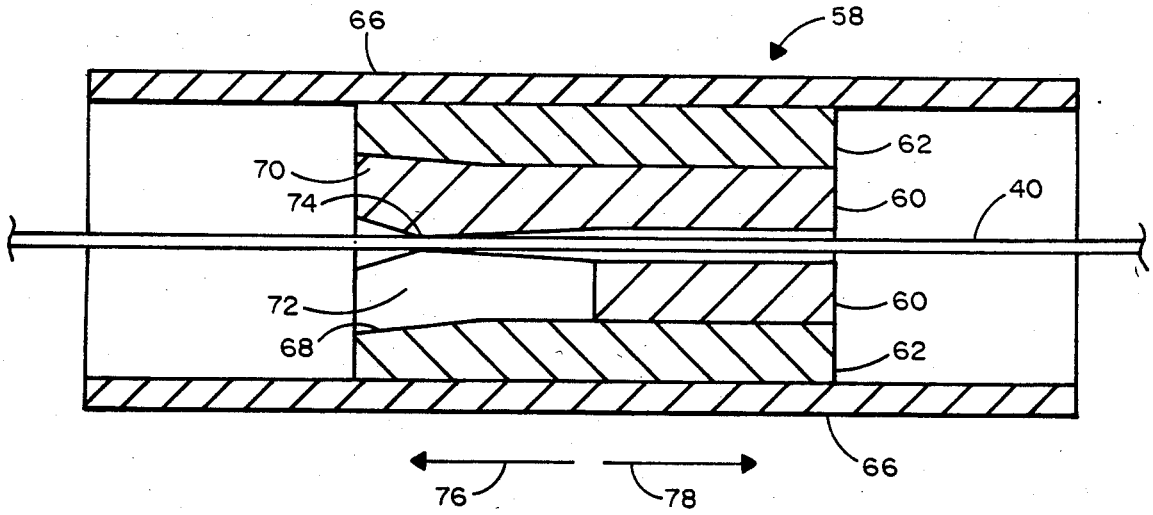
FIG. 7 is a cross section taken along lines 7—7 of FIG. 6.

The details of a collet 60, which is representative of the collets 22 and 38 of FIGS. 1–5, is now described while referring to the cross head assembly 58 shown at FIGS. 6 and 7 of the drawings. It is to be understood that while other suitable collets may be known to those skilled in the art, the collet herein described is intended to be illustrative of one preferred embodiment.

As previously described, the collet 60 is disposed (in frictional engagement) at the interior of a piston 62 for receipt of a portion of wire 40. Piston 62 is connected to a connecting rod 64 and adapted for reciprocating movement through a cylinder 66 (in response to the rotation of a drive wheel). Piston 62 contains an outwardly projecting (with respect to the longitudinal axis thereof) flare 68 extending around the interior surface at one end of piston 62 for receiving a correspondingly flared end surface of collet 60.

The collet 60 may be fabricated from any material (e.g. such as that which is known as TEFLON) which has a characteristic spring memory and resistance to wear. Collet 60 has a generally cylindrical shape and a plurality (e.g. three) of resilient clamping jaws 70 extending from and uniformly spaced around one end thereof. Each jaw 70 of a pair of adjacent collet jaws is separated from one another by a narrow gap 72. Each of the jaws 70 is flared outwardly (with respect to the longitudinal axis of collet 60) at an angle corresponding to the flare 68 of piston 62, so that the flared exterior surface of jaws 70 can be received and mated against the flared surface of piston 62. Moreover, the flared interior surfaces of jaws 70 cooperate to form a narrow restriction 74 at which point the wire 40 is securely engaged. The generally cylindrical collet 70 is dimensioned so as to permit wire 40 to pass freely therethrough except at the narrow restriction 74 which is formed between jaws 70 when collet 60 is located at the interior of piston 62, as is best illustrated in FIG. 7. Such an alignment of collet 60 within piston 62 to cause the resilient collet jaws 70 to compress and thereby clamp against wire 40 occurs when piston 62 moves through cylinder 66 in a direction indicated by arrow 76. In this case, the collet 60 acts to pull wire 40 during the stroke of piston 62 through cylinder 66 in a direction represented by arrow 76.

When the direction of piston 62 through cylinder 66 is reversed, corresponding to a direction indicated by arrow 78, collet 60 experiences a change of inertia. Accordingly, collet 60 is moved a short distance out of its friction engagement with the flare 68 of piston 62 and forced in a direction (indicated by arrow 76) which is opposite to the direction of movement of piston 62 through cylinder 66. When the collet jaws 70 clear the flared end of piston 62, the spring memory of the collet material results in a natural expansion of the jaws and a corresponding widening of the restriction 74 so as to cause a relaxation of the grip on wire 40. In this case, the collet 60 acts to release the wire 40 (and thereby facilitate the unimpeded feed of wire in a single direction) during the stroke of piston 62 through cylinder 66 in a direction indicated by arrow 78. Another reversal of the direction of piston 62 through cylinder 66 (in a direction indicated by arrow 76) forces the jaws 70 of collet 60 back into engagement with the flare 68, so as to reestablish the restriction 74 and the advance of wire 40.

As was described above, the clamping jaws of collets 22 and 38 are arranged in opposite alignment with respect to one another. That is, the jaws of collet 22 extend in a direction indicated by arrow 78 of FIG. 7, and the jaws of collet 38 extend in a direction indicated by arrow 76, so that collet 22 engages a wire at a time when collet 38 releases the wire, and visa versa.

It will be apparent that while a preferred embodiment of the invention has been shown and described, various modifications and changes may be made without departing from the true spirit and scope of the invention. By way of example, each of the shafts of rotating drive wheels 10 and 36 and rotating cutting wheel 24 may be connected through conventional gearing to a common drive shaft which is powered by an electric motor. The details of such common drive shaft and gearing by which to operate wheels 10, 36, and 24 have been omitted to avoid confusion with the claimed invention.

Having thus set forth a preferred embodiment of the present invention, what is claimed is:

1. A wire handling and cutting apparatus for feeding a continuous supply of wire to a wire cutting assembly so that wire sections having a particular, predetermined length can be cut off the supply, said wire handling and cutting apparatus comprising wire feeding and receiving cranks and associated first and second cross head assemblies, said wire feeding crank including a drive wheel adapted for rotational movement, said first cross head assembly including a first cylinder and a first piston disposed for reciprocating movement therethrough, said first piston having means for engaging the supply of wire, said wire engaging means adapted for reciprocating movement with said first piston in a direction towards and then away from said wire cutting assembly, and a first connecting rod extending between the drive wheel of said wire feeding crank and the wire engaging means of said first cross head assembly, such that the rotational movement of said drive wheel is transferred by way of said connecting rod to cause the reciprocating movement of said wire engaging means, said wire engaging means advancing the supply of wire to said cutting assembly during that portion of its reciprocating movement which is in a direction towards said cutting assembly, said wire receiving crank including a drive wheel adapted for rotational movement, said second cross head assembly including a second cylinder and a second piston disposed for reciprocating movement therethrough, said second piston having means for engaging a section of the wire supply that has been advanced by said first cross head assembly past said cutting assembly to be cut thereby, said wire engaging means being adapted for reciprocating movement with said piston in a direction towards and then away from said cutting assembly, and a second connecting rod extending between the drive wheel of said wire receiving crank and the wire engaging means of said second cross head assembly, such that the rotational movement of said drive wheel is transferred by way of said connecting rod to cause the reciprocating movement of said wire engaging means, said wire engaging means pulling the section of wire that has been cut from the supply thereof away from said cutting assembly during that portion of its reciprocating movement which is in a direction away from said cutting assembly.

2. The wire handling and cutting apparatus recited in claim 1, wherein the drive wheel of said wire feeding crank has an adjustment slot extending therethrough, said connecting rod being connected to said drive wheel at a certain location along said slot so as to thereby establish the particular length of the wire sections to be cut off the wire supply.

3. The wire handling and cutting apparatus recited in claim 1, wherein said first piston includes a collet associated therewith and adapted for reciprocating movement with said piston, said collet including a plurality of clamping jaws which cooperate to securely engage the supply of wire for advancing said wire to said cutting assembly during the recurring portion of the piston stroke through said cylinder in a direction towards said cutting assembly, said collet jaws releasing the supply of wire during the recurring portion of the piston stroke in an opposite direction through said cylinder away from said cutting assembly, such that said collet jaws operate to effect the forward feed of said wire supply in a single direction towards said cutting assembly.

4. The wire handling and cutting apparatus recited in claim 1, wherein said wire cutting assembly includes a pair of cutting wheels, each of which having at least one cutting tang projecting outwardly therefrom and only one of which wheels being adapted for rotation, said cutting wheels being spaced from one another to permit the supply of wire to be received between opposing tangs thereof for cutting off a section of said supply.

5. The wire handling and cutting apparatus recited in claim 1, wherein said second piston includes a collet associated therewith and adapted for reciprocating movement with said piston, said collet including a plurality of clamping jaws which cooperate to securely engage the section of wire for pulling the wire section away from said cutting assembly during the recurring portion of the piston stroke through said cylinder in a direction away from said cutting assembly, said collet jaws releasing the section of wire during the recurring portion of the piston stroke in an opposite direction through said cylinder towards said cutting assembly, such that said collet jaws operate to effect the movement of a wire section engaged thereby in a single direction away from said cutting assembly.

6. A wire handling and cutting apparatus for feeding a continuous supply of wire to a cutting assembly so that wire sections can be cut off from the supply, said apparatus comprising wire feeding and receiving cranks and respective first and second cross head assemblies, each of said wire feeding and receiving cranks including a drive wheel adapted for rotational movement, said first and second cross head assemblies including respective first and second wire engaging means adapted for reciprocating movement in directions towards and away from said wire cutting assembly, and first and second connecting rods extending between the respective wheels of said wire feeding and receiving cranks and the first and second wire engaging means of said first and second cross head assemblies, such that the rotational movements of said drive wheels being transferred by way of said respective connecting rods to cause the reciprocating movement of said first and second wire engaging means, said first wire engaging means securely engaging the supply of wire for advancing said wire to said cutting assembly when said wire engaging means moves in a direction towards said cutting assembly and releasing the supply of wire when said wire engaging means moves in an opposite direction away from said cutting assembly, and said second wire engaging means securely engaging the supply of wire for pulling a section of cut wire away from said cutting assembly when said wire engaging means moves in a direction away from said cutting assembly and releasing said wire section when said wire engaging means moves in an opposite direction towards said cutting assembly, each of said first and second wire engaging means cooperating with one another to cause the movement of said wire supply and the sections cut off therefrom in a single direction.

7. The wire handling and cutting apparatus recited in claim 6, wherein each of said first and second wire engaging means comprises a collet having a plurality of clamping jaws which cooperate to securely engage or release said wire supply, depending upon the direction of movement of said collet.

* * * * *